United States Patent [19]

Critchley et al.

[11] Patent Number: 4,972,652

[45] Date of Patent: Nov. 27, 1990

[54] CLOSURES FOR CONTAINERS

[75] Inventors: Richard J. Critchley, Chorley; Samuel R. Oldham, Hyde, both of United Kingdom

[73] Assignee: British Nuclear Fuels plc, Warrington, England

[21] Appl. No.: 307,096

[22] Filed: Feb. 7, 1989

[30] Foreign Application Priority Data

Feb. 26, 1988 [GB] United Kingdom ..... 8804500

[51] Int. Cl.[5] ..... B65B 43/40

[52] U.S. Cl. ..... 53/468; 53/109; 53/381 A

[58] Field of Search ..... 53/468, 492, 109, 381 A; 252/633

[56] References Cited

U.S. PATENT DOCUMENTS 3,783,576 1/1974 Riesenberg ..... 53/109

3,910,006 10/1975 James ..... 53/46 X 4,494,363 1/1985 Rica ..... 53/468 X

*Primary Examiner*—John Sipos

*Attorney, Agent, or Firm*—William R. Hinds

[57] ABSTRACT

Radioactive waste is loaded from a cell 10 into a drum 16 by sealing the drum about a port 12 in the cell, attaching the drum lid to the port door by clamp jaws 30 engaging a boss 76, withdrawing the port door and drum lid 69 into the cell in back-to-back fashion, loading the drum and replacing the lid. The lid has an annular lip 72, and the lid is deformable from a first state in which the lip engages the underside of the drum rim 65 and the lid engages the outer surface of the rim, and a second state in which the lip is free from engagement with the rim, thereby allowing removal of the lid.

The jaws are moved into clamping engagement by initial movement of the jaws relative to the door.

7 Claims, 4 Drawing Sheets

CLOSURES FOR CONTAINERS

Figure 1:
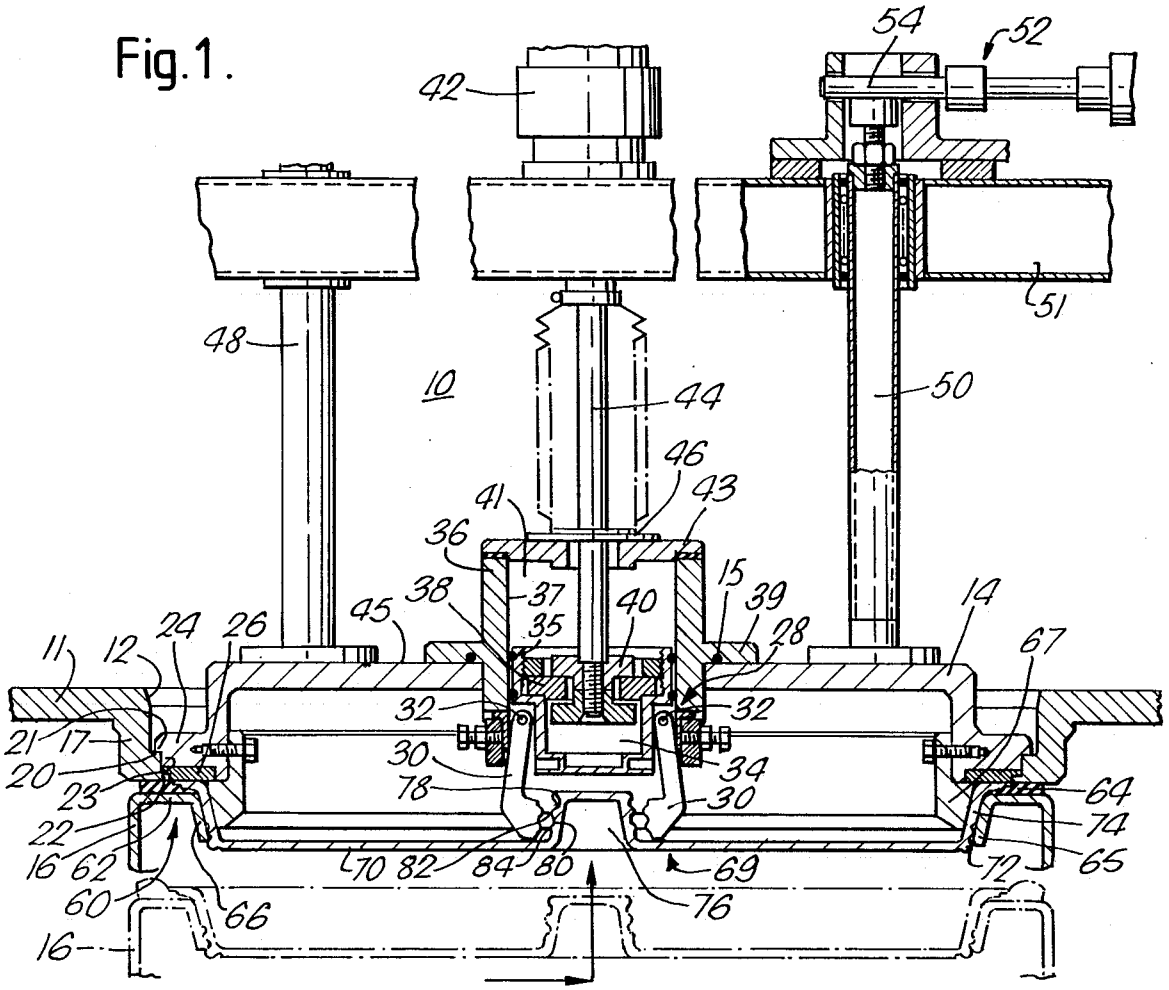

This invention relates to closures for containers.

British Specification 2088836 and US Specification 4446063 describe the charging of radioactive waste into a steel drum having a lid in which a dispenser closure and the lid are withdrawn into the dispenser in back-to-back fashion. In the closed position the lid is an interference fit in an opening in a wall of the drum.

According to the present invention there is provided a closure for a container, said closure comprising a deformable member provided with means for engaging an underside of a rim around a mouth of the container, the member being deformable from a first state in which the engaging means engages the underside of the rim and the member engages an outer surface of the rim to a second state in which the engaging means is free from said engagement with the underside of the rim to allow the withdrawal of the closure from the mouth of the container.

The member may comprise a peripheral portion and a central portion, and the means for engaging the underside of the rim may be located at a junction of the peripheral portion and the central portion, and the peripheral portion may engage the outer surface of the rim. The deformable member may be formed from a plastics material for example polyethylene.

The means for engaging the underside of the rim may comprise an annular lip or may comprise a pip or a plurality of angularly spaced pips.

The peripheral portion may be profiled so as to conform to the outer surface of the rim and the peripheral portion may extend initially outwardly relative to the surface of the central portion and then radially outwardly relative to the central portion.

Preferably the member is provided with a boss on the central portion and the boss may be provided with means for engaging a clamping device.

It is also preferable that the member is resiliently deformable so that the member can be returned to its first state from its second state. The first state may comprise the normal state of the member and the member may be pulled through the agency of the boss to deform the member into its second state.

According to the present invention there is also provided a method of transferring material from a dispenser having a port closed by a port door to a container having a deformable closure, the closure being provided with means for engaging an underside of a rim around a mouth of the container, said method comprising sealing the container to the port with a peripheral portion of the closure sealed to the port door, the closure being in a first state in which the engaging means engages the underside of the rim and the peripheral portion of the closure engages an outer surface of the rim, deforming the closure into a second state in which the engaging means is free from engagement with the underside of the rim, withdrawing the door and closure in back-to-back fashion into the dispenser, transferring material from the dispenser to the container, replacing the closure in the mouth of the container, and returning the closure to its first state to close the container.

According to the present invention there is also provided apparatus for use in transferring material from a dispenser having a port to a container having a mouth provided with a closure, which closure is deformable from a first state in which the closure closes the mouth to a second state in which the closure is removable from the mouth, said apparatus comprising a port door locatable in the port, the door being provided with clamping means arranged to clamp onto a boss on the closure to hold the closure to the door, the clamping means being arranged for movement relative to the door so that movement of the clamping means effects deformation of the closure between the first and second states, and means for withdrawing the port door from the port and into the dispenser and for replacing the port door in the port.

Figure 2:
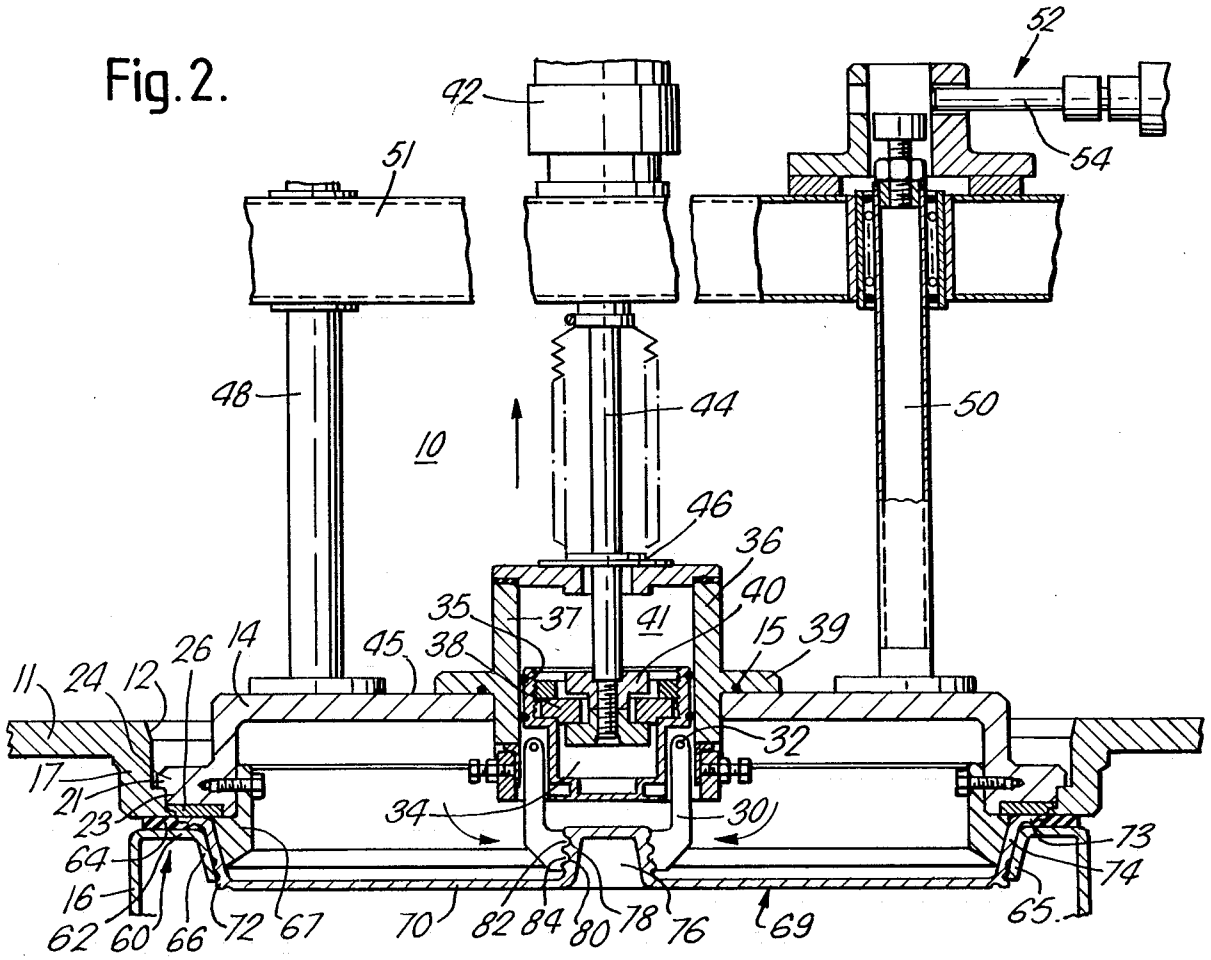
Figure 3:
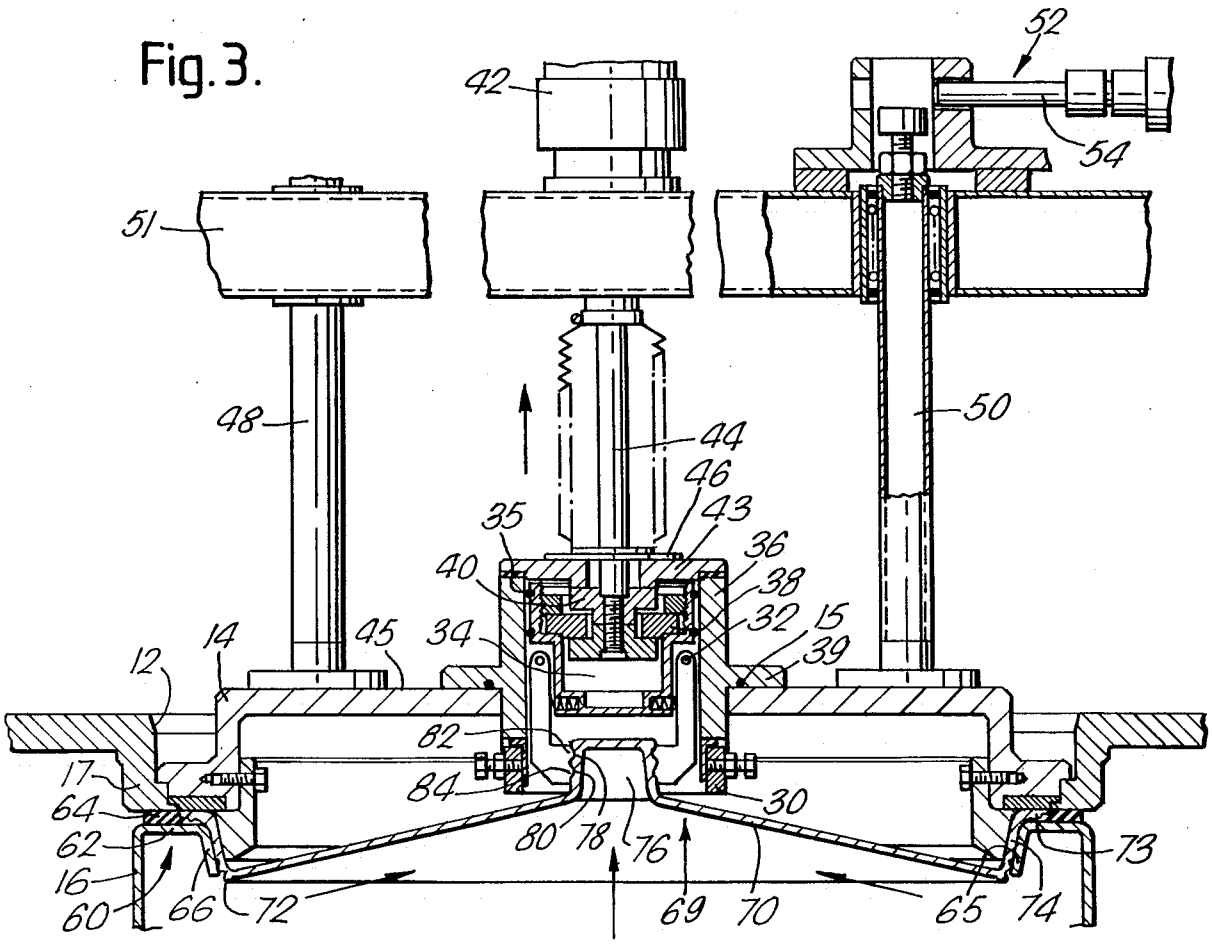
Figure 4:
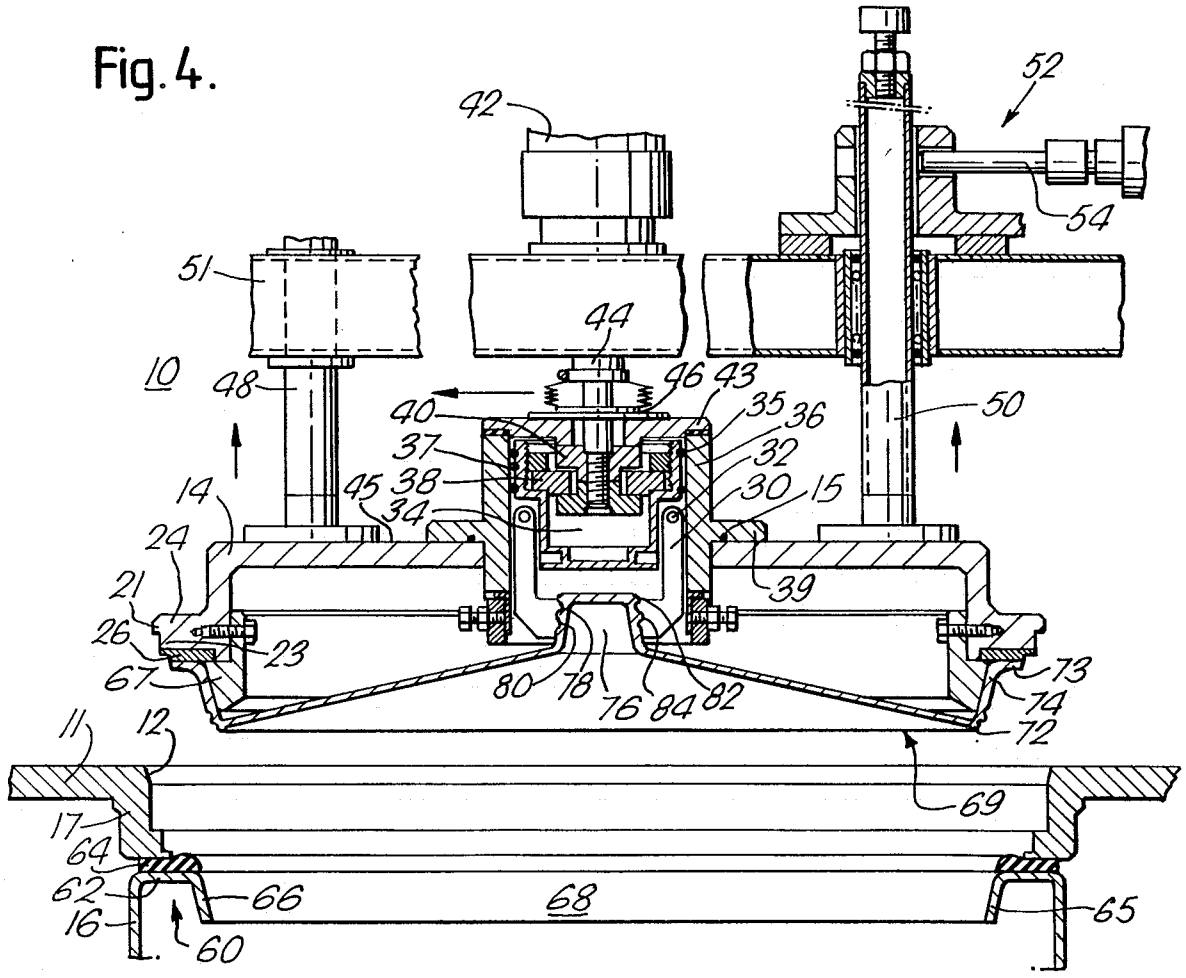

The invention will now be further described, by way of example only, with reference to the accompanying drawings, in which FIGS. 1 to 4 are fragmentary side views part in vertical section of a cell used for handling radioactive material and a waste disposal drum and illustrate the stages involved in charging the drum.

The drawings show a cell 10, used for handling radioactive material, which has a port 12 in a wall 11, the port 12 being closed by a port door 14, and a waste ring 17 extends downwards from the port 12, and has two inwardly extending annular steps 20 and 22 on which downwardly facing peripheries of shoulders 21, 23 on a peripheral flange 24 of the port door 14 respectively seat when the door 14 is closed. The inner shoulder 23 on the flange 24 has an annular seal 26, the radially outermost portion of which seal is compressed by the seal ring 17 to seal the port door 14 to the seal ring 17.

The centre of the port door 14 is provided with a clamp arrangement 28 comprising a pair of jaws 30 respectively pivotally mounted on spindles 32 to a hollow clamp body 34 which is slidably mounted within a cavity 41 in a hollow generally tubular housing 36 which extends with a close fit through an aperture in the port door 14. Spaced annular seals 35 carried by body 34 engage the inner surface 37 of housing 36. An outward flange 39 on housing 36 engages upper surface 45 of door 14 with an interposed annular seal 15. The interior of the body 34 includes an annular member 38 which locates in a peripheral recess in a connecting member 40 which is H-shaped in vertical cross-section. The connecting member 40 connects the clamp body 34 to a piston rod 44 movable in a pneumatic cylinder 42, the rod 44 extending through an aperture in a top end wall 43 of the housing 36 which is closed by a seal 46. Guide rods 48 and 50 extend upwards from the port door 14 into the cell 10 on opposite sides of the rod 44 and sealingly locate in a support 51. A locking arrangement 52 is also provided which comprises a slidable piston 54 which when activated blocks the path of the guide rod 50 and hence prevents withdrawal of the port door 14 into the cell 10.

The drawings also show a polythene (polyethylene) drum 16 whose upper face 60 comprises an outer annular portion 62 provided with an annular drum seal 64 and a turned over inner portion 66 which extends downwards and inwards towards the interior of the drum so that the drum 16 has a rim of inverted U-shape. The mouth 68 of the drum 16 is closed by a polythene lid 69 having a central portion 70 which extends between the inner edge of the upper face 60 and has a lip 72 at its periphery which locates under the inner face of the bottom edge 65 of the inner portion 66 of the upper face 60. The outer portion 74 of the lid is profiled to extend along the inner portion 66 of the upper face 60 an outer marginal edge portion 73 resting on a radially inner portion of the drum seal 64. A boss 76 is provided at the centre of the lid 69 and has two outer annular recesses 78 and 80 which are engagable by pips 82 and 84 respectively on the jaws 30. The jaws 30 extend through the open bottom end of the housing 36.

In use, the drum 16 has its mouth 68 closed by the lid 69. The central portion 70 of the lid 69 is flat, the lip 72 is engaged under the edge face 65 of the inner portion 66 of the upper face 60 and the edge portion 73 of the lid 69 rests on the drum seal 64. The drum 16 is offered up to the port 12 with the aid of annular guide 67 depending from the door 14, and sealed to the port door 14 by means of the port seal 26 which is compressed between the seal ring 17 and the drum 16 and with seal 64 engaging the flange 17. The jaws 30 are in an open position (see FIG. 1) and the pneumatic cylinder 42 is activated to pull the jaws 30 into the housing 36 and as they move they are forced to move together by engagement with housing 36 and clamp onto the boss 76 with the pips 82 and 84 engaged in the recesses 78 and 80 (see FIG. 2). As the piston 44 is moved further the jaws 30 pull the boss 76 and deform the lid 69 by deflection so that the lip 72 is pulled from under the edge 65 of the inner portion 66. When the H-shaped connecting member 40 reaches the upper end of the cavity 41 the lip 72 is completely clear of the portion 66 (see FIG. 3) and on unlocking the locking arrangement 52 further movement of the rod 44 pulls the port door 14 and the lid 69 in back-to-back fashion into the cell 10 (see FIG. 4). Waste material is then transferred from the cell 10 into the drum 16. The rod 44 is lowered and the port door 14 is thus replaced in the port 12 and at the same time the lid 69 replaced in the mouth 68 of the drum 16. At this stage the lid 69 is still in its deformed state and the lip 72 is clear of the upper face 60 of the drum 16. Further downward movement of the clamp body 34 in the cavity 41 allows the lid 69 to return to its normal state with the lip 72 engaged below the upper face 60 of the drum 16 as above. The lid 69 is again sealed to the drum 16 by seal 26, the port door 14 locked using the locking mechanism 52 and then the drum 16 removed from the port 12. The drum 16 can be placed inside a further drum for storage purposes.

Instead of an annular lip 72 there may be a plurality of angularly spaced pips, or one pip, engageable beneath edge face 65.

The lid can be used with containers used to store radioactive waste or other materials and is particularly useful where it desirable that the lid cannot be easily removed by accident. The arrangement may find use in orientations other than that shown.

We claim:

1. A method of transferring material from a dispenser having a port closed by a port door to a container having a deformable closure, the closure being provided with means for engaging an underside of a rim around a mouth of the container, said method comprising sealing the container to the port with a peripheral portion of the closure sealed to the port door, the closure being in a first state in which the engaging means engages the underside of the rim and the peripheral portion of the closure engages an outer surface of the rim, deforming the closure into a second state in which the engaging means is free from engagement with the underside of the rim, withdrawing the door and closure in back-to-back fashion into the dispenser, transferring material from the dispenser to the container, replacing the closure in the mouth of the container, and returning the closure to its first state to close the container.

2. Apparatus for use in transferring material from a dispenser having a port to a container having a mouth provided with a closure, which closure is deformable from a first state in which the closure closes the mouth to a second state in which the closure is removable from the mouth, said apparatus comprising a port door locatable in the port, the door being provided with clamping means arranged to clamp onto a boss on the closure to hold the closure to the door and to deform the closure into its second state to permit removal from the container, means for moving the clamping means relative to the door so that movement of the clamping means effects deformation of the closure between the first and second states, and means for withdrawing the port door from the port and into the dispenser and for replacing the port door in the port.

3. Apparatus as claimed in claim 2, in which the clamping means comprises opposed clamping jaws, and means engageable by the jaws for urging the jaws into clamping engagement with the boss.

4. Apparatus as claimed in claim 2, in which the clamp means and the boss have inter-engageable formations.

5. Apparatus as claimed in claim 4, in which the inter-engageable formations comprise projections and recesses.

6. Apparatus as claimed in claim 2, in which the port door is provided with annular seal means for engaging the closure.

7. Apparatus for use in transferring material from a dispenser to a container, comprising container means having a deformable closure means, the closure means being provided with means for engaging an underside of a rim around a mouth of the container means, the closure means being deformable between a first state in which the engaging means engages the underside of the rim and the peripheral portion of the closure means engages an outer surface of the rim and a second state in which the engaging means is free from engagement with the underside of the rim, means defining a port for the dispenser, door means for opening and closing the port, means for selectively sealing the container means to the port with a peripheral portion of the closure means sealed to the port door means, means for selectively deforming the closure means into its second state to permit removal from the container means and for returning the closure means into its first state upon replacement in the mouth of the container means, and means for selectively withdrawing the door means and closure means in back-to-back fashion into the dispenser to permit transfer of material from the dispenser to the container means and for replacing the closure means in the mouth of the container means after said transfer.

* * * * *